US005575476A

United States Patent [19]

Yang

[11] Patent Number: 5,575,476

[45] Date of Patent: Nov. 19, 1996

[54] GAME APPARATUS

[76] Inventor: Ju-Hsun Yang, 58, Ma Yaun West St., Taichung, Taiwan

[21] Appl. No.: 458,117

[22] Filed: Jun. 5, 1995

[51] Int. Cl.[6] ..... A63F 9/08

[52] U.S. Cl. ..... 273/153 S; 273/155

[58] Field of Search ..... 273/153 R, 153 S, 273/155

[56] References Cited

U.S. PATENT DOCUMENTS

| | | | |
|---|---|---|---|
| 4,416,453 | 11/1983 | Sasso | 273/153 S |
| 4,553,754 | 11/1985 | Wiggs et al. | 273/153 S |
| 5,116,052 | 5/1992 | Pop | 273/153 S |
| 5,215,305 | 6/1993 | Hsun | 273/153 S |
| 5,333,869 | 8/1994 | Hsun | 273/153 S |

FOREIGN PATENT DOCUMENTS

| | | | |
|---|---|---|---|
| 1263266 | 10/1986 | U.S.S.R. | 273/153 S |

*Primary Examiner*—Steven B. Wong

[57] ABSTRACT

A game device includes a parallelepiped body having six outer shells engaged on six surfaces. The outer shells each includes a tube engaged with the body and each includes four notches formed in the peripheral portion. A number of slides are slidably engaged in the notches of the outer shells and movable between the notches. Six groups of patterns are printed on the outer surfaces of the slides. The users may move the slides of same group of patterns to the notches of an identical outer shell for educational purposes.

1 Claim, 6 Drawing Sheets

GAME APPARATUS

BACKGROUND OF THE INVENTION

1. Field of the Invention

The present invention relates to a game apparatus, and more particularly to a game apparatus for educational purposes.

2. Description of the Prior Art

The closest prior art of which applicant is aware is his prior U.S. Pat. No. 5,215,305 to Hsun, filed May 18, 1992. The game apparatus comprises a spherical body having a number of slides that may be moved and engaged in the slots of different shells.

The present invention has arisen to provide a game apparatus having a novel configuration.

SUMMARY OF THE INVENTION

The primary objective of the present invention is to provide a game apparatus which may be used for educational purposes.

In accordance with one aspect of the invention, there is provided a game apparatus comprising a parallelepiped body including six surfaces each having a recess formed therein and each having an aperture formed therein, six pairs of inner shells and outer shells engaged on the six surfaces respectively and each including a substantially semi-spherical shape, the inner shells each including a center portion having a hole formed therein and aligned with the apertures of the body, the inner shells each including a peripheral portion having four spaced slots formed therein, the outer shells each including a tube extended through the holes of the inner shells and the apertures of the body, the tubes each including a free end portion having an annular flange radially extended outward therefrom for engaging with the body so as to rotatably secure the inner shells and the outer shells to the body, the outer shells each including a peripheral portion having four notches formed therein for aligning with the slots of the inner shells, the outer shells each including an outer surface having an orifice formed therein, six caps each including an extension engaged in the orifices of the outer shells such that the caps move in concert with the outer shells, and a plurality of slides slidably engaged in the notches of the outer shells and movable between the notches, the slides each including an outer surface having six groups of patterns provided thereon.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
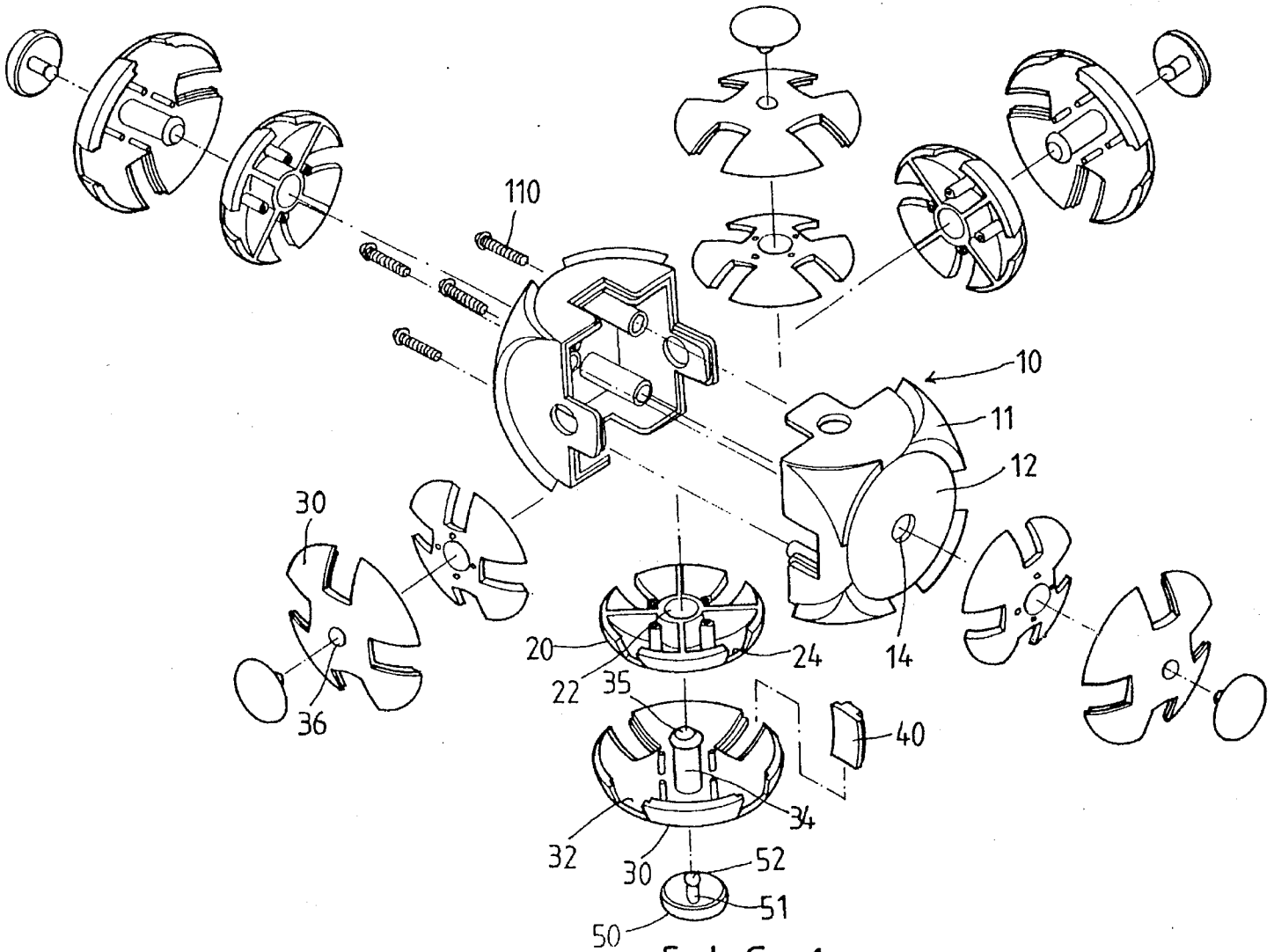
FIG. 1 is an exploded view of a game apparatus in accordance with the present invention.
Figure 2:
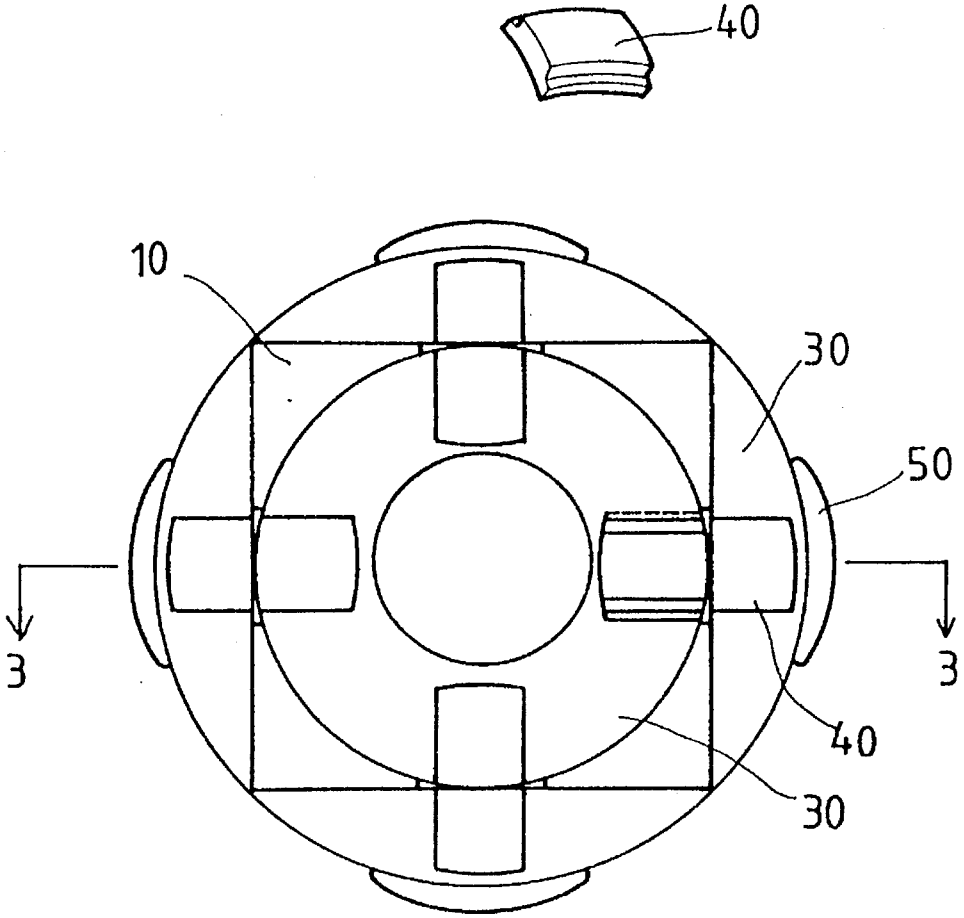
FIG. 2 is a plane view of the game apparatus.
Figure 3:
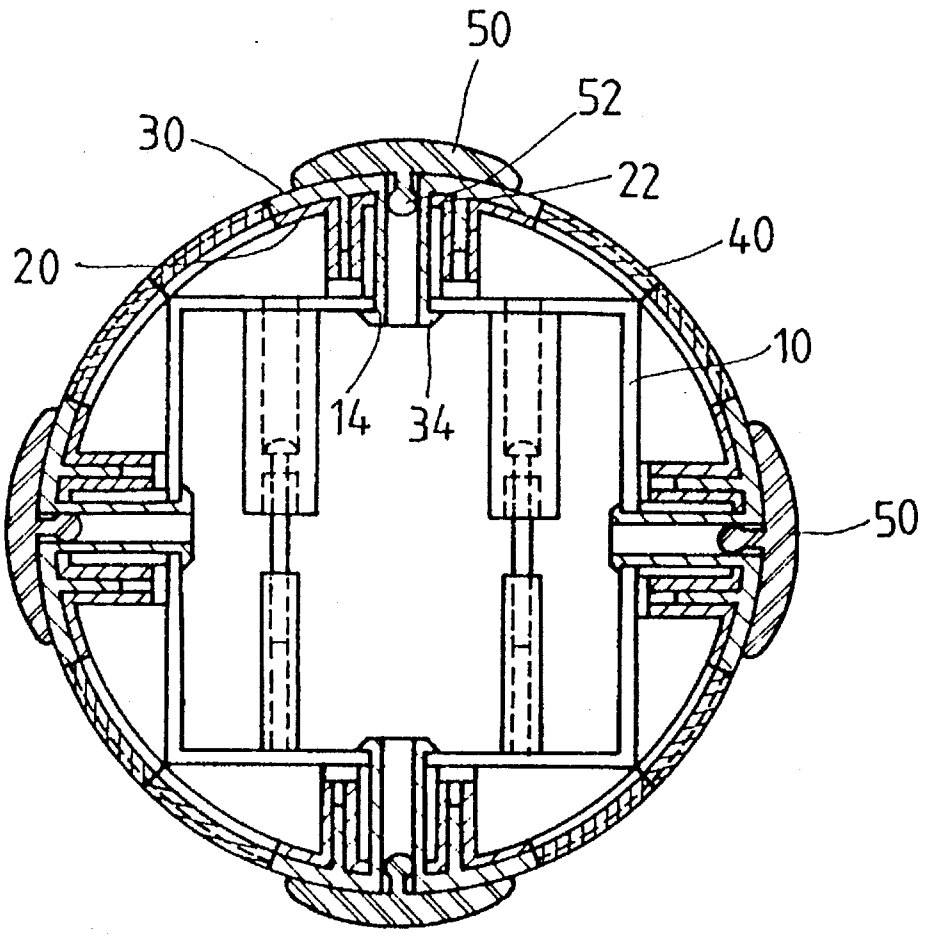
FIG. 3 is a cross sectional view taken along lines 3—3 of FIG. 2.
Figure 5:
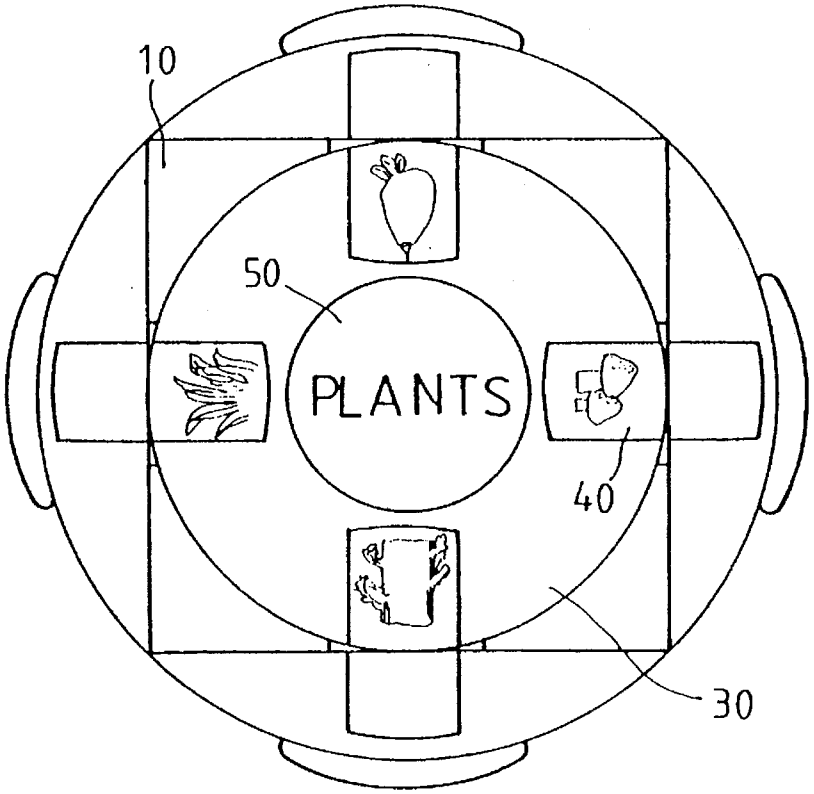
FIGS. 4, 5, 6, 7, and 8 are plane views illustrating the operation of the game apparatus.
Figure 4:
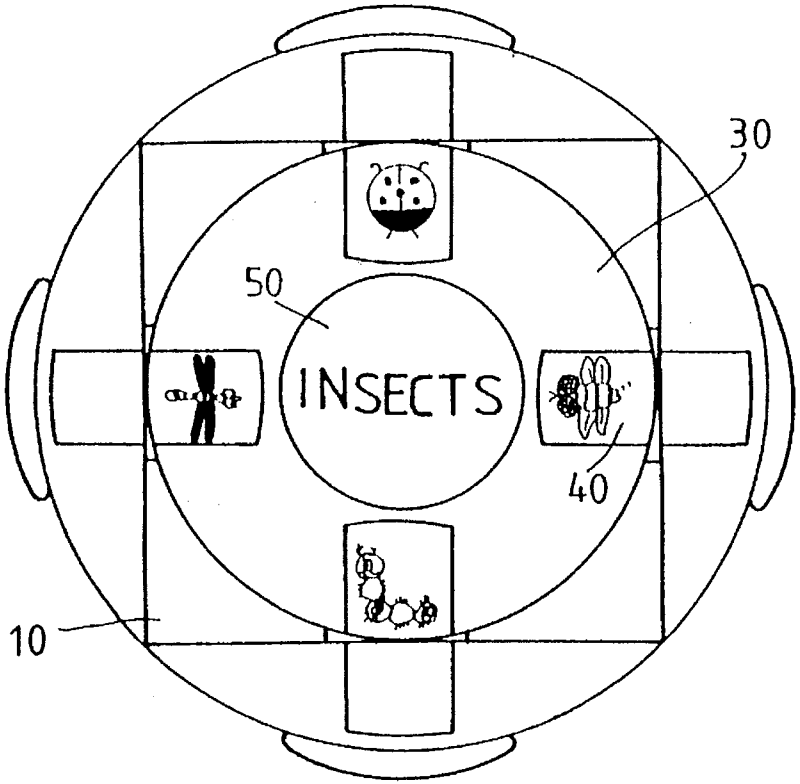
Figure 7:
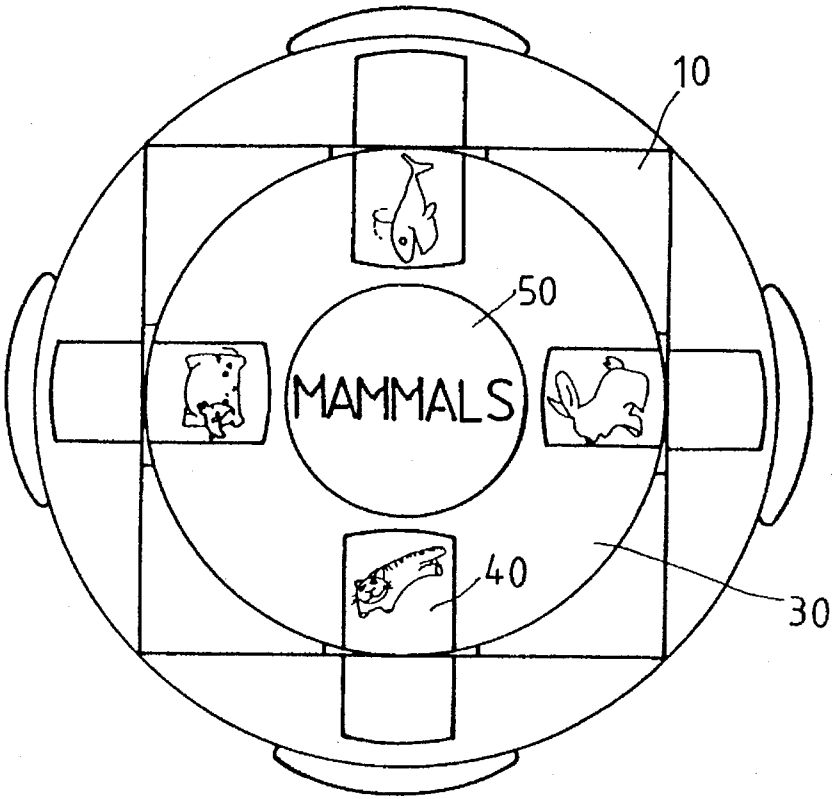
Figure 6:
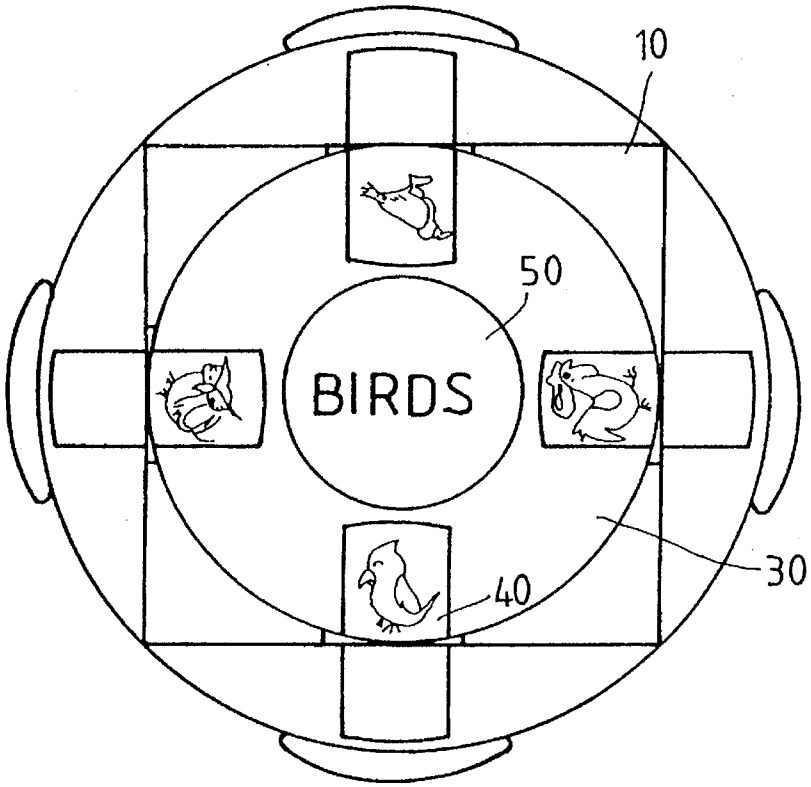

Referring to the drawings, and initially to FIGS. 1 to 3, a game apparatus in accordance with the present invention comprises a parallelepiped body 10 including two halves 11 secured together by screws 10. The body 10 includes six surfaces 12 each having a recess formed therein and each having an aperture 14 formed therein. Six pairs of inner shells and outer shells 20, 30 are engaged on the six surfaces 12 respectively and each includes a substantially semi-spherical shape. The inner shells 20 each includes a hole 22 formed in the center portion and aligned with the apertures 14 of the body 10, and each includes a peripheral portion having four spaced slots 24 formed therein. The outer shells 30 each includes a tube 34 extended therein for engaging through the holes 22 of the inner shells 20 and the apertures 14 of the body 10. The tubes 34 each includes an annular flange 35 radially extended outward from the free end portion for engaging with the body 10 so as to rotatably secure the inner shells 20 and the outer shells 30 to the body 10. The outer shells 30 each also includes a peripheral portion having four notches 32 formed therein for aligning with the slots 24 of the inner shells 20. The outer shells 30 each includes an outer surface having an orifice 36 formed therein. Six caps 50 each includes an extension having an enlarged head 52 formed thereon for forcefitting in the orifices 36 of the outer shells 30 such that the caps 50 move in concert with the outer shells 30. A number of slides 40 are slidably engaged in the slots 24 and in the notches 32 of the shells and movable between the notches 32 of the outer shells 30.

Figure 8:
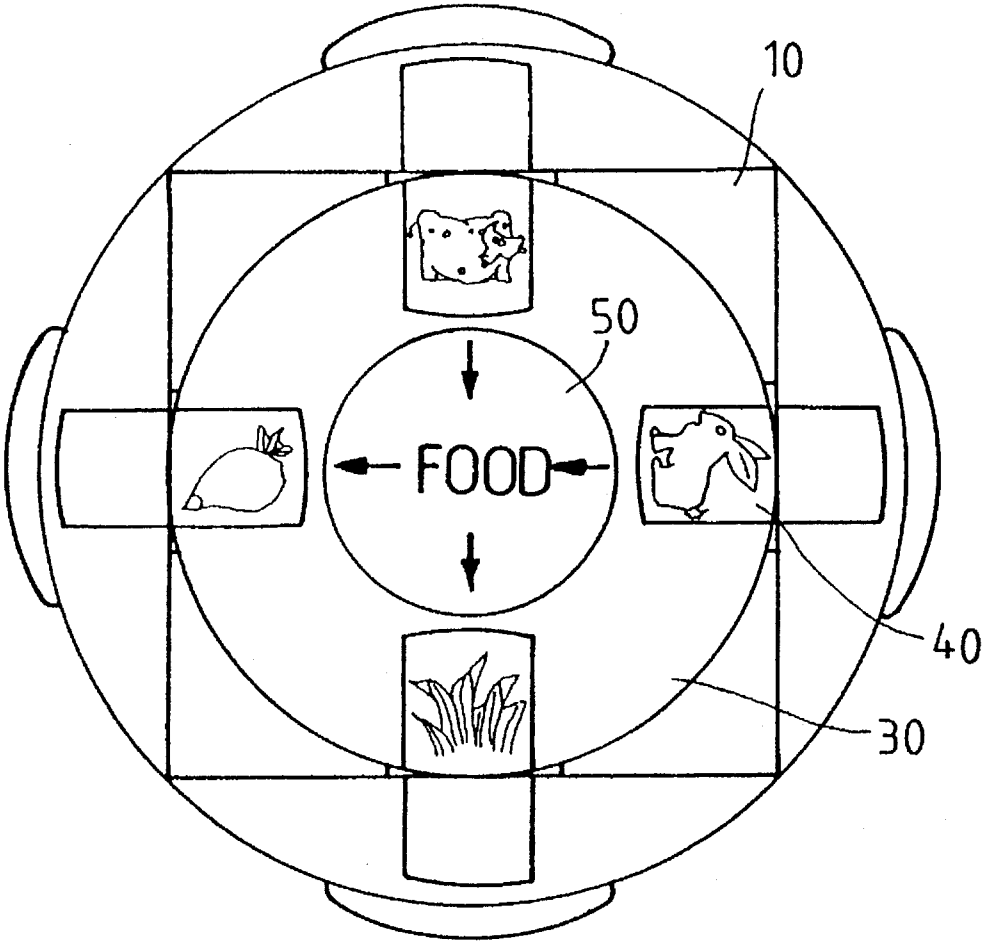

Referring next to FIGS. 4 to 8, the outer surfaces of the slides 40 may be printed with six groups of patterns, such as insects (FIG. 4), plants (FIG. 5), birds (FIG. 6), mammals (FIG. 7) and food (FIG. 8). The outer surfaces of the caps 50 may be printed with the names of the groups. The users may move the same groups of the patterns around the caps having the name of the group thereon.

Accordingly, the game apparatus may be provided for educational purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A game apparatus comprising:

a parallelepiped body including six surfaces each having a recess formed therein and each having an aperture formed therein, six pairs of inner shells and outer shells engaged on said six surfaces respectively and each including a substantially semi-spherical shape, said inner shells each including a center portion having a hole formed therein and aligned with said apertures of said body, said inner shells each including a peripheral portion having four spaced slots formed therein, said outer shells each including a tube extended through said holes of said inner shells and said apertures of said body, said tubes each including a free end portion having an annular flange radially extended outward therefrom for engaging with said body so as to rotatably secure said inner shells and said outer shells to said body, said outer shells each including a peripheral portion having four notches formed therein for aligning with said slots of said inner shells, said outer shells each including an outer surface having an orifice formed therein, six caps each including an extension engaged in said orifices of said outer shells such that said caps move in concert with said outer shells, and a plurality of slides slidably engaged in said notches of said outer shells and movable between said notches, said slides each including an outer surface, and six groups of patterns being provided on said outer surfaces of said slides.

* * * * *